US006672610B2

(12) United States Patent
Freisinger et al.

(10) Patent No.: US 6,672,610 B2
(45) Date of Patent: Jan. 6, 2004

(54) SNOWBOARD BINDING

(75) Inventors: Henry Freisinger, Vienna (AT); Karl Stritzl, Vienna (AT); Franz Ollinger, Hundsheim (AT); Hubert Würthner, Hainburg (AT); Gernot Jahnel, Neudorf (AT); Raimund Premauer, Oggau (AT); Helmut Brandt, Leopoldsdorf (AT); Alois Himmetsberger, Vienna (AT)

(73) Assignee: HTM Sport- und Freizeitgeräte Aktiengesellschaft (AT)

( * ) Notice: Subject to any disclaimer, the term of this patent is extended or adjusted under 35 U.S.C. 154(b) by 0 days.

(21) Appl. No.: 10/059,860

(22) Filed: Jan. 30, 2002

(65) Prior Publication Data

US 2002/0101064 A1 Aug. 1, 2002

(30) Foreign Application Priority Data

Jan. 31, 2001 (EP) ..... 01102092

(51) Int. Cl.[7] ..... A63C 9/16
(52) U.S. Cl. ..... 280/623; 280/11.36
(58) Field of Search ..... 280/11.36, 14.21, 280/14.22, 613, 617, 623, 625, 626, 627, 633, 634, 636

(56) References Cited

U.S. PATENT DOCUMENTS 4,058,326 A * 11/1977 Faulin ..... 280/617
5,899,483 A 5/1999 Paris
5,997,027 A 12/1999 Jungkind
6,003,893 A * 12/1999 Hansen ..... 280/634
6,007,077 A * 12/1999 Moe ..... 280/14.22
6,032,974 A * 3/2000 Saillet ..... 280/11.36
6,065,770 A * 5/2000 Hansen et al. ..... 280/617
6,105,993 A * 8/2000 Gignoux ..... 280/613
6,382,641 B2 * 5/2002 Dennis et al. ..... 280/14.22

FOREIGN PATENT DOCUMENTS

DE 404898 B 3/1999
EP 0824942 A1 2/1998
JP 8-150237 * 11/1996 ..... A63C/9/16
WO WO 97/39808 10/1997

OTHER PUBLICATIONS

European Search Report dated Aug. 6, 2001, 3 pages.

* cited by examiner

*Primary Examiner*—Frank Vanaman
(74) *Attorney, Agent, or Firm*—Ostrolenk, Faber, Gerb & Soffen, LLP

(57) ABSTRACT

A binding in particular a step-in binding, for retaining a soft boot on a sliding device, in particular a snowboard, having retaining elements for the boot and having a calf support (8) which can be pivoted into snowboarding and step-in positions and, via a tread element (9) which is connected to it and is within reach of the boot, can be moved into the snowboarding position, in which the calf support (8) is secured against accidentally pivoting out of the snowboarding position. In the snowboarding position, with the tread element (9) subjected to loading, the calf support (8) can be supported, on binding-mounted supporting parts (20), against pivoting on its pivoting bolt (10) into the step-in position. As a result of the tread element (9) being relieved of loading, in order to eliminate the support, the calf support (8) can be displaced, in particular automatically, in relation to the bolt (10).

9 Claims, 4 Drawing Sheets

SNOWBOARD BINDING

BACKGROUND OF THE INVENTION

Figure 1:
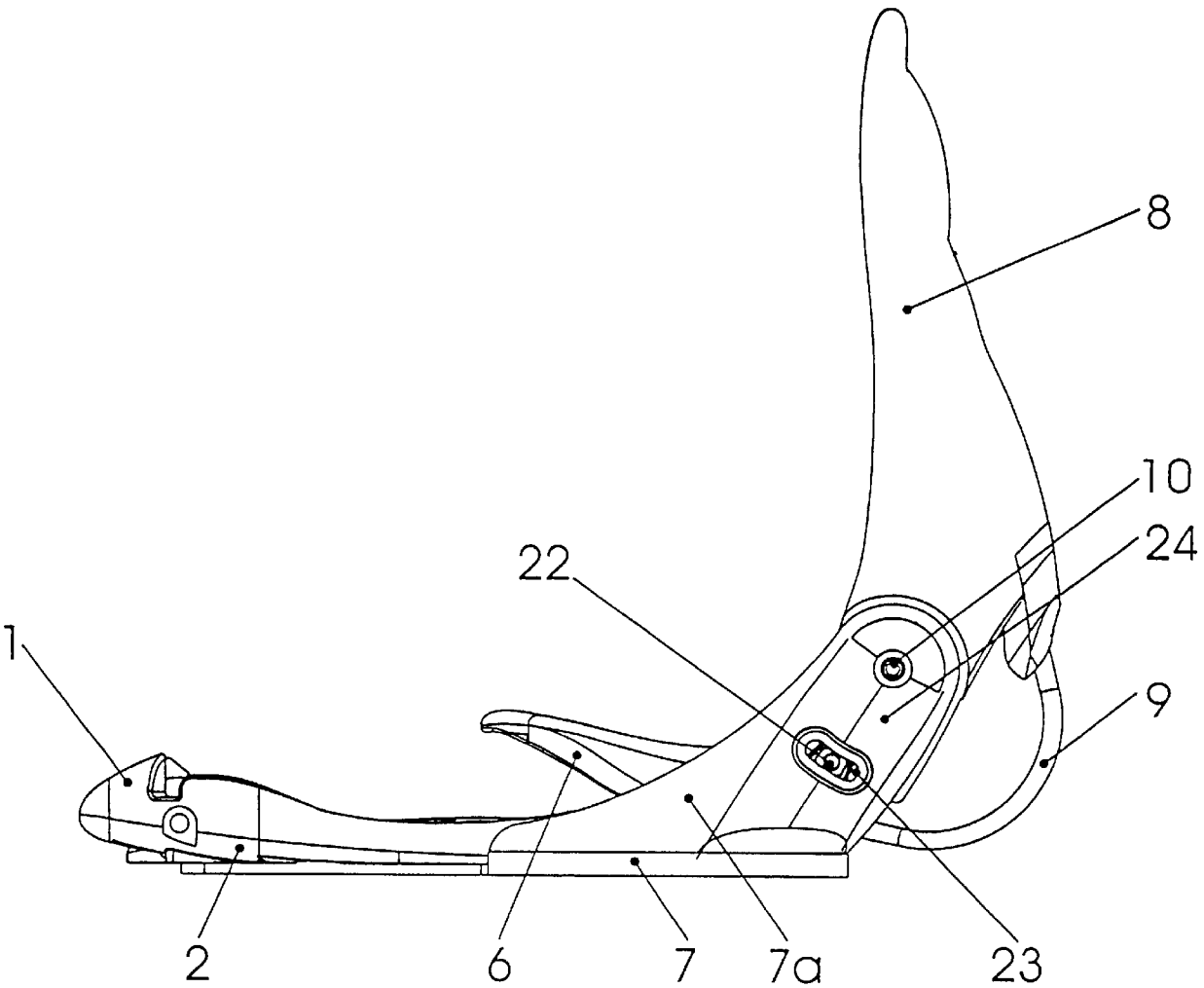

The invention relates to a binding for retaining a soft boot on a sliding device, in particular a snowboard, having retaining elements for the boot and having a calf support which can be pivoted into snowboarding and step-in positions and, via a tread element which is connected to it and is within reach of the boot, can be moved into the snowboarding position, in which the calf support is secured against accidentally pivoting out of the snowboarding position.

Such a binding is known, for example, from WO-A-9739808. This binding is a soft-boot binding with a tensioning strap which comprises a number of parts and has a tensioning device by means of which the tensioning strap is drawn together once the boot has been introduced into the binding, and the boot is thus forced onto the base plate of the binding. A calf support is provided, and this can be rotated about a transverse axis on side parts of the base plate. This calf support is provided with side parts which each have, in their front region, a latching protrusion which, in the closed position, the snowboarding position, has latching noses of locking hooks mounted pivotably on the base plate engaging over it. The calf support is thus secured against pivoting back in an undesired manner. The calf support may be provided with a tread element which is within reach of the boot sole, with the result that, when the boot is introduced into the binding, the calf support automatically pivots into its snowboarding position and locks automatically in this position.

AT-B-404 898 discloses a step-in binding for snowboards in the case of which retaining elements which are arranged on the sole region of the boot interact with retaining elements of the binding and can be brought into releasable engagement therewith. Such a binding is usually likewise provided with a calf support, which can be pivoted into the snowboarding and step-in positions, in order to support the snowboarder's leg.

A further embodiment of a step-in binding for soft boots is illustrated and described in U.S. Pat. No. 5,899,483. The retaining elements provided on the rear region of the boot sole here are pins which, in the snowboarding position, engage in depressions which are provided on the inside of binding-mounted side parts. Lateral continuations of a calf support are located beneath the pins. The locking means receives a hook which engages over the pins from above and, at the same time, thus also retains the continuations of the calf support, and thus the calf support itself, in the snowboarding position.

During snowboarding, the calf supports, which are generally shell-like plastic parts possibly provided with padding, are subjected to high as well as alternating loading. Locking devices which retain the calf supports in the snowboarding position thus have the advantage that they help to absorb the forces which occur. In the case of the binding known from U.S. Pat. No. 5,899,483, the locking means for the calf support in the snowboarding position is coupled to the binding locking means, which requires specific configuration and coordination of the interacting components.

In particular in the case of a step-in binding with retaining elements on the boot and on the binding, it is possible, in principle, in the case of a calf support which can be pivoted into the snowboarding position via a tread element, to dispense with a locking means for the calf support in the snowboarding position since the boot fixed in the binding retains the calf support in the snowboarding position. The forces to which the calf support is subjected by the snowboarder's leg during snowboarding may then prove problematic, these forces meaning that the loadability of the material of the calf support and/or the loadability of the tread element are subject to stringent requirements.

SUMMARY OF THE INVENTION

The object of the invention, then, in the case of a binding of the type mentioned in the introduction, is to ensure by straightforward means that the calf support and the tread bracket can withstand all the loading which occurs during snowboarding, the intention being for it not to be necessary to have any separate locking mechanism for the calf support. The sought-after solution is intended, furthermore, to allow the calf support to be used for different binding systems.

The set object is achieved according to the invention in that in the snowboarding position, with the tread element subjected to loading, the calf support, beneath its pivot pin, can be supported, on binding-mounted supporting parts, against pivoting into the step-in position, and as a result of the tread element being relieved of loading, in order to eliminate the support, the calf support can be displaced, in particular automatically, in relation to its pivot pin.

The support which the invention provides for the calf support absorbs forces and thus prevents the occurrence of forces which could overload the calf support and the tread element. By virtue of the calf support being arranged in a displaceable manner, the support is eliminated when the tread element is relieved of loading, and the calf support is moved into its step-in position. The mechanism provided and/or the components provided according to the invention are completely independent of the retaining elements of the binding and/or of the boot and, in addition, may be accommodated and/or arranged at a point remote from these retaining elements.

In a preferred embodiment of the invention, the supporting parts are parts which are fastened on the inside of side parts of a bearing block, and they have rearwardly directed supporting surfaces. This configuration is favorable in terms of production and, furthermore, also has the advantage that via the fastening means, which will preferably be a screw, the position of each supporting part can be adjusted and fixed via a slot formed in the side part of the bearing block. A change in the position of the supporting parts also changes the position of the supporting surfaces thereof, as a result of which it is possible to change the forwardly inclined position of the calf support within a certain range.

A straightforward and expedient configuration of the calf support provides that the latter is provided, on both sides, with in each case one extension which is respectively provided with a supporting surface which, in the snowboarding position, can be supported on the supporting surface of the relevant supporting part.

The calf support is subjected, on both sides, to the action of at least one spring, which forces the calf support upward. When the boot is removed from the binding, the springs bring about or assist release of the supporting surfaces of the calf support from the supporting surfaces of the supporting parts, with the result that the calf support can pivot rearward and the boot can easily be removed from the binding.

A functionally reliable and displaceable arrangement of the calf support, which is a straightforward design, provides that the calf support is arranged pivotably on binding-mounted bolts or the like, the bolts extending through slots of the calf support. The length of the slots determines the clearance for movement, the magnitude of the displacement distance, of the calf support.

As far as possible, ice and/or snow should not be able to have an adverse effect on the function of the springs. It is thus favorable if each spring is configured as a compression spring and is arranged in a recess of the calf support, above the bolt, and has one end supported on the bolt and has its other end supported on the calf support. In this arrangement, it is easily possible to ensure that the springs are accommodated in an at least largely protected region.

In the step-in position, without specific handling being necessary, the intention is for the calf support already to be located in a position in which the tread element is within easy reach of the boot. This can easily be achieved in that each supporting part has, on its top side, a stop against which the extension of the calf support is positioned in the step-in position.

In order to ensure in each case, even with the occurrence of relatively high loading and forces, that the supporting parts remain in their adjusted position, it is advantageous if a groove formation or the like which is provided on the supporting part can be wedged with a groove formation or the like which is formed on the inside of the side part of the bearing block.

BRIEF DESCRIPTION OF THE DRAWING(S)

Figure 2:
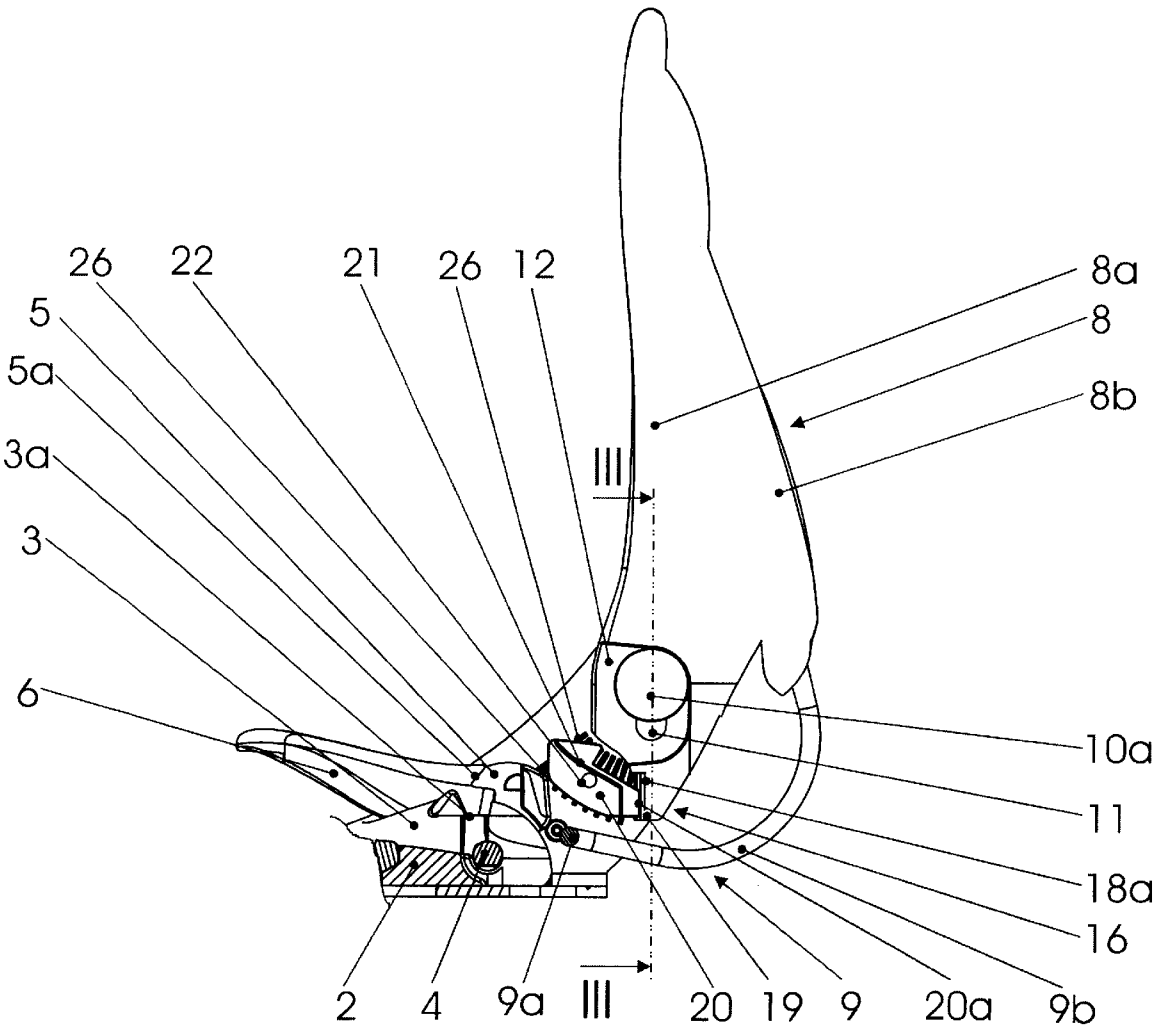
Figure 3:
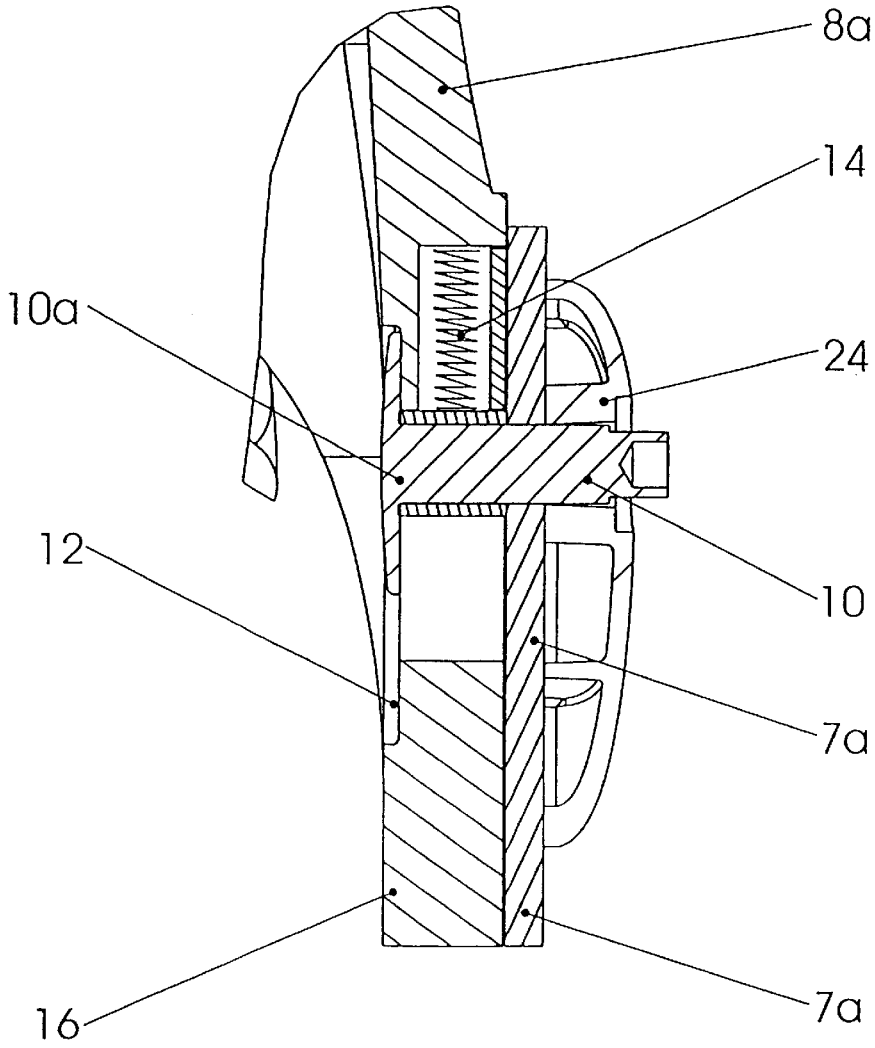
Figure 4:
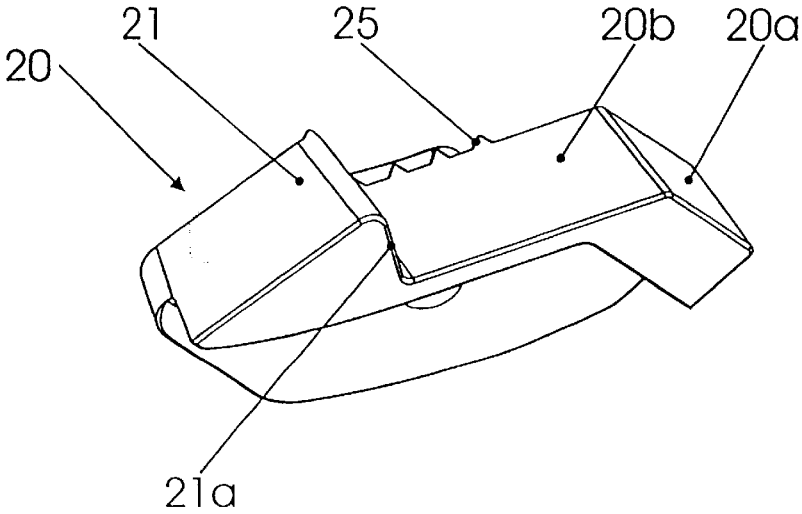
Figure 5:
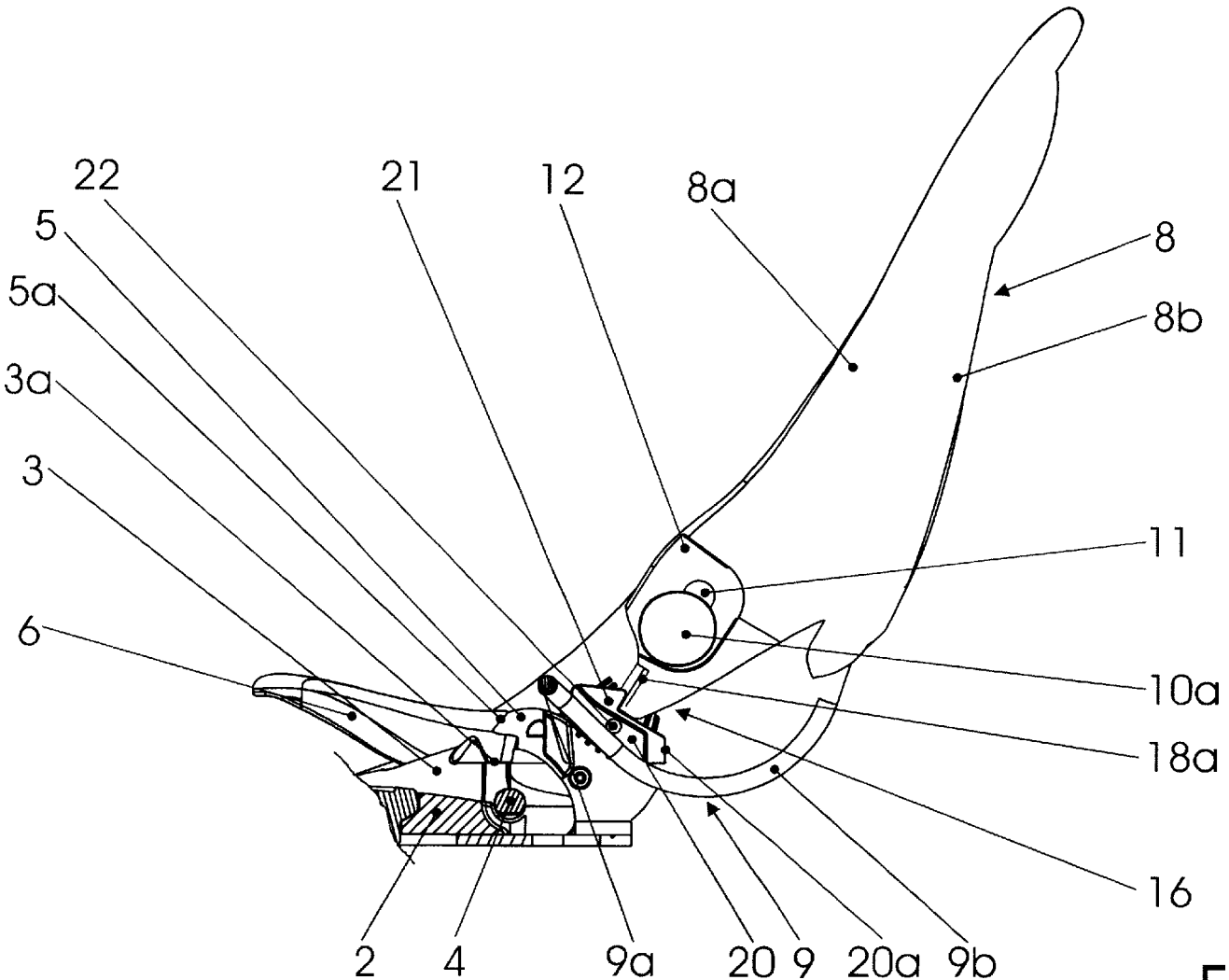

Further features, advantages and details of the invention will now be described in more detail with reference to the drawings, which illustrate an exemplary embodiment and in which:

FIG. 1 shows a side view of a snowboard binding,

FIG. 2 shows a longitudinal section through the rear region of the snowboard binding in the snowboarding position with the boot inserted, although the boot is not illustrated, FIG. 3 shows a vertical section along line III—III from FIG. 2, FIG. 4 shows an oblique view of a supporting part, and FIG. 5 shows a sectional illustration analogous to FIG. 2, but in the step-in position with the calf support pivoted rearward.

DETAILED DESCRIPTION OF EMBODIMENTS OF THE INVENTION

The binding illustrated in the figures of the drawing is a so-called step-in binding for soft boots. The binding is provided with a pair of front retaining elements and a pair of rear retaining elements, which each interact with a pair of latching elements which are accommodated in the region of the sole of the boot. The constituent parts of the binding which form the retaining elements as well as the latching elements on the boot may be configured, in principle, in accordance with the retaining elements and latching elements of the binding which is illustrated and described in AT-B-404 898, and of the boot which is likewise disclosed here. The essential constituent parts of the retaining elements and of the latching elements are described briefly hereinbelow.

The front two retaining elements of the binding are rigid jaws 1 arranged on a base plate 2, it being possible to see one of the jaws 1 from FIG. 1. Protrusions which are arranged laterally on the front region of the sole of a boot (not shown), and are configured in the form of brackets or the like, can be inserted into the jaws 1 and thus retained in a vertical and lateral direction.

FIG. 2 shows constituent parts of one of the two rear retaining elements. A latching body 3, which is mounted on the base plate, has a latching trough 3*a* for in each case one latching pin of a pair of latching pins arranged on the rear region of the sole of the boot (not illustrated). In their latched-in position, the latching pins inserted in the latching trough 3*a* each have a locking hook 5, which is mounted pivotably about a pin 4, engaging around them from above. The locking hooks 5 can be pivoted into their release position, counter to the force of a spring, in a manner which is not illustrated. Via an opening lever 6, it is possible for the two locking hooks 5 to be pivoted and thus for the latching pins (not illustrated) to be released in order for the boot to be removed from the binding. The locking hooks 5 are restored by the springs which act on them. Run-on slopes 5*a* on each locking hook 5 ensure that, when the boot is introduced into the binding, the latching pins provided on the boot briefly force away the locking hooks 5 to the extent where the latching pins pass into the latching troughs 3*a*. The locking hooks 5 snap automatically into their starting position.

As, in particular, FIG. 1 shows, the binding, in the rear region, has a bearing block 7 which is arranged on the base plate 2 and is provided laterally with in each case one raised side part 7*a*. On the two side parts 7*a*, a calf support 8 is mounted such that it can be rotated about a transverse axis. The calf support 8 is a shell-like support which is produced in particular from plastic by injection molding, has two side parts 8*a* and a rear part 8*b* connecting the side parts, and supports the snowboarder's leg to the rear. Fixedly connected to the calf support 8 is a tread element which, in the embodiment illustrated, is a tread bracket 9 which essentially comprises two rearwardly curved lateral legs 9*b* and a tread leg 9*a* which connects said lateral legs in the front region. The two lateral legs 9*b* of the tread bracket 9 are encapsulated by injection molding during production of the calf support 8 and are thus fixedly connected to the calf support 8.

The calf support 8 is mounted not just pivotably, but also displaceably, on the bearing block 7. In the embodiment illustrated, the calf support 8 can be displaced essentially perpendicularly to the top side of the snowboard. As, in particular, FIG. 3 shows in the region of one side part 7*a* of the bearing block 7—a mirror-inverted arrangement is provided in the region of the second side part 7*a*—in each case one bolt 10 is provided for the pivotable mounting of the calf support 8, said bolt being fastened in each case on one of the side parts 7*a* of the bearing block 7. Each bolt 10 is provided on the inside with a disk-like head 10*a* which is countersunk in a hollow depression 12 on the inside of the side part 8*a* of the calf support 8. The bolt 10 is configured to be long enough in order to be used on the outside for fitting a covering part 24 thereon. In relation to the calf support 8, the bolt 10, in the position illustrated in FIG. 3, is located at the top end region of a slot 11 which is formed in the side part 8*a* of the calf support 8 and runs approximately perpendicularly to the top side of the snowboard. Formed above the bolt 10, in the side part 8*a* of the calf support 8, is a recess 15 which is provided as a mount for a spring 14 and is covered on the outside. The compression spring 14 accommodated in the recess 15 has one end supported, from above, on the bolt 10, which in this case is enclosed by a sleeve, and has its second end, at the top end of the recess 15, pressing onto the calf support 8.

The position shown in FIGS. 2 and 3 corresponds to the snowboarding position, in which the boot has moved the calf support 8 into an upright position via the tread bracket 9 and retains there. In this position, as FIG. 2 shows, the bottom end region of each side part 8*a* is supported on a supporting part 20 fastened on the inside of the side part 7*a* of the bearing block 7. For this purpose, each side part 8*a* is provided, at its bottom end region, with an extension 16 which has a forwardly oriented supporting surface 18*a* which runs approximately parallel to the extent of the slot 11 and butts against a supporting surface 20*a* of the supporting part 20. In the case of the calf support 8 being subjected to loading by the snowboarder's leg, it is thus ensured that the calf support 8 is supported, as a result of which any overloading in the material of the calf support 8 and in the regions of connection to the tread bracket 9 is avoided. In the step-in position (see FIG. 5), utilizing the clearance for movement available as a result of the slots 11, the springs 14, which are accommodated in the two side parts 8*a* of the calf support 8, push the calf support 8 upwards in relation to the two bolts 10.

As can be seen from FIG. 2, each supporting part 20 is fastened on the relevant side part 7*a* of the bearing block 7 by means of a screw 22. FIG. 4 shows the configuration of the supporting part 20. Accordingly, the supporting part 20 is an elongate component which, at one end region, has the supporting surface 20*a* which is to be directed to the rear, and, on its top side, has a sliding surface 20*b* which terminates at a supporting nose 21, which has a rearwardly oriented supporting surface 21*a* which is inclined in relation to the vertical.

With the boot latched in, the calf support 8 has been pivoted into its upright position via the tread bracket 9, and the supporting surfaces 18*a* butt against the supporting surfaces 20*a*.

When the boot is released from the binding, it is possible for the two compression springs 14 either to raise the calf support 8 automatically or at least to assist a raising action, and thus to release the calf support from the supporting part 20. By virtue of the calf support 8 being pivoted to the rear, the extensions 16 finally reach the supporting noses 21 of the supporting parts 20, as a result of which the calf support 8 is prevented from pivoting any further. It is further possible for in each case one latching protrusion 19 to be formed on the extensions 16, by means of which latching protrusion the calf support 8 engages under the supporting parts 20, beneath the supporting surfaces 20*a*. The latching protrusions 19 are of comparatively short configuration in order to ensure easy, in particular automatic, release of the same when the boot is removed.

When the boot is introduced into the binding, the tread bracket 9 is within reach of the boot sole. The calf support 8 is thus pivoted forward, the extensions 16 moving along the sliding surfaces 20*b* of the supporting parts 20. Once the edges have reached the supporting surfaces 20*a*, the calf support 8 assumes the snowboarding position, which is shown in FIG. 2.

It is possible for the forwardly inclined position of the calf support 8 to be adjusted within a certain range by virtue of a change in position of the two supporting parts 20 on the side parts 7*a* of the bearing block 7. For this purpose, the position of the screw 22, which fixes the supporting part 20, can be adjusted in a slot 23 of the side part 7*a*, said slot running concentrically with the bolt 10. The forwardly inclined position selected for the calf support 8 is fixed by the screw 22 being tightened and is additionally secured in that a groove formation 25 (see FIG. 4), which is provided on the inside of each supporting part 20 and runs in the radial direction in relation to the axis of rotation of the calf support 8, wedges with a correspondingly oriented groove formation 26 on the inside of each side part 7*a*.

The invention is not restricted to the exemplary embodiment illustrated. It is thus the case that the invention is not restricted to bindings with a certain type of retaining mechanism for the boot. It is thus also possible to use the invention, for example, for bindings where the boot is retained by tensioning straps. Provision may further be made for the tread bracket only to be fastened subsequently on the calf support and for a pedal or the like to be provided instead of the tread bracket. Furthermore, the calf support may be provided with at least one reinforcement, which is, for example, a metal part which is encapsulated by injection molding during production of the support.

What is claimed is:

1. A binding for retaining a soft boot on a sliding device, comprising:

retaining elements for the boot;

a calf support which can be pivoted into snowboarding and step-in positions by a tread element which is connected to the calf support and is engageable by the boot, the calf support being moveable into the snowboarding position in response to loading on said tread element;

in the snowboarding position, the calf support being secured against accidental pivoting out of the snowboarding position, the calf support being supported against pivoting, with respect to a bolt mounted on binding-mounted supporting parts, into the step-in position, wherein the supporting parts are fastened on the inside of side parts of a bearing block and have rearwardly directed supporting surfaces which support said calf support in said snowboarding position, wherein the calf support has, on each side, an integral extension which is respectively provided with a supporting surface which, in the snowboarding position, is supported on the supporting surface of the respective supporting part, wherein each supporting part has, on its top side, a stop up to which the extension of the calf support can be pivoted in the step-in position; and as a result of the tread element being relieved of loading, the calf support being displaceable in relation to said bolt.

2. The binding as claimed in claim 1, wherein the calf support is subjected, on each side, to the action of at least one spring which urges the calf support upward.

3. The binding as claimed in claim 1, wherein the calf support is arranged pivotably, on both sides, on said binding-mounted bolts, which extend through slots of the calf support.

4. The binding as claimed in claim 1, wherein the position of each supporting part can be adjusted and fixed via a slot formed in the side part of the bearing block.

5. The binding as claimed in claim 4, wherein a groove formation which is provided on the supporting part is engageable with a groove formation which is formed on the inside of the side part.

6. The binding as claimed in claim 1, wherein said calf support is displaced automatically in relation to said bolt when said tread element is relieved of loading.

7. The binding as claimed in claim 1, wherein said sliding device is a snowboard.

8. A binding for retaining a soft boot on a sliding device, comprising:

retaining elements for the boot;

a calf support which can be pivoted into snowboarding and step-in positions by a tread element which is connected to the calf support and is engageable by the boot, the calf support being moveable into the snowboarding position in response to loading on said tread element;

in the snowboarding position, the calf support being secured against accidental pivoting out of the snowboarding position, the calf support being supported against pivoting, with respect to a pivot mounted on binding-mounted supporting parts, into the step-in position, and as a result of the tread element being relieved of loading, the calf support being displaceable in relation to said pivot, wherein the calf support is subjected, on each side, to the action of at least one spring which urges the calf support upward, and wherein each spring is a compression spring and is arranged in a recess of the calf support and has one end supported at said pivot, on which the calf support is arranged in a pivotable manner, and has its other end supported on the calf support.

9. A binding for retaining a soft boot on a sliding device, comprising:

retaining elements for the boot;

a calf support which can be pivoted into snowboarding and step-in positions by a tread element which is connected to the calf support and is engageable by the boot, the calf support being moveable into the snowboarding position in response to loading on said tread element;

in the snowboarding position, the calf support being secured against accidental pivoting out of the snowboarding position, the calf support being supported against pivoting, with respect to a pivot mounted on binding-mounted supporting parts, into the step-in position, and as a result of the tread element being relieved of loading, the calf support being displaceable in relation to said pivot, wherein the calf support has, on each side, one extension which is respectively provided with a supporting surface which, in the snowboarding position, is supported on the supporting surface of the respective supporting part, and wherein each supporting part has, on its top side, a stop up to which the extension of the calf support can be pivoted in the step-in position.

* * * * *